United States Patent [19]

James

[11] Patent Number: 4,906,036

[45] Date of Patent: Mar. 6, 1990

[54] PIVOTING ADJUSTMENT SCREW

[75] Inventor: Darrell L. James, Placentia, Calif.

[73] Assignee: The Hartwell Corporation, Placentia, Calif.

[21] Appl. No.: 249,625

[22] Filed: Sep. 26, 1988

[51] Int. Cl.[4] ..... E05C 3/04

[52] U.S. Cl. ..... 292/202; 292/DIG. 60; 411/384; 411/395; 411/537; 403/224

[58] Field of Search ..... 292/251, 256.71, 256.73, 292/256.75, DIG. 60, DIG. 5, 202; 411/383, 384, 395, 537, 397; 403/224, 408.1

[56] References Cited

U.S. PATENT DOCUMENTS

| | | | |
|---|---|---|---|
| 827,230 | 7/1906 | Goeppinger | 411/395 X |
| 1,046,600 | 12/1912 | Kahler | 411/537 X |
| 1,077,046 | 10/1913 | Dodds | 411/397 X |
| 1,940,466 | 12/1933 | Sneed | 403/408.1 |
| 2,179,959 | 11/1939 | Schroedter | 403/224 |
| 3,382,630 | 5/1968 | Chivers | 411/537 X |
| 3,749,362 | 7/1973 | O'Connor et al. | 411/537 X |
| 4,334,599 | 6/1982 | Ritsema et al. | 411/537 X |
| 4,484,849 | 11/1984 | Klimowicz | 411/397 |
| 4,548,434 | 10/1985 | Princell | 292/DIG. 5 |
| 4,577,912 | 3/1986 | Snyder | 411/537 X |
| 4,601,602 | 7/1986 | Schnitzler | 403/224 X |
| 4,693,503 | 9/1987 | Bisbing | 292/229 X |
| 4,732,519 | 3/1988 | Wagner | 403/408.1 X |
| 4,830,557 | 5/1989 | Harris et al. | 411/537 |

FOREIGN PATENT DOCUMENTS

| | | | |
|---|---|---|---|
| 2087503 | 5/1982 | United Kingdom | 411/537 |

*Primary Examiner*—Gary L. Smith
*Assistant Examiner*—Michael J. Milano
*Attorney, Agent, or Firm*—Lyon & Lyon

[57] ABSTRACT

A pivoting adjustment screw for mounting the bolt of a latch to provide vibrational damping along with increasing preload as the contact point of the adjustment screw to the mating structure shifts in a shock or vibrational environment. The adjustment screw includes a pivoting portion which permits the screw to pivot which allows a rotating rather than a scraping or abrading movement in response to the relative movement between the elements being connected.

21 Claims, 2 Drawing Sheets

FIG. 1.
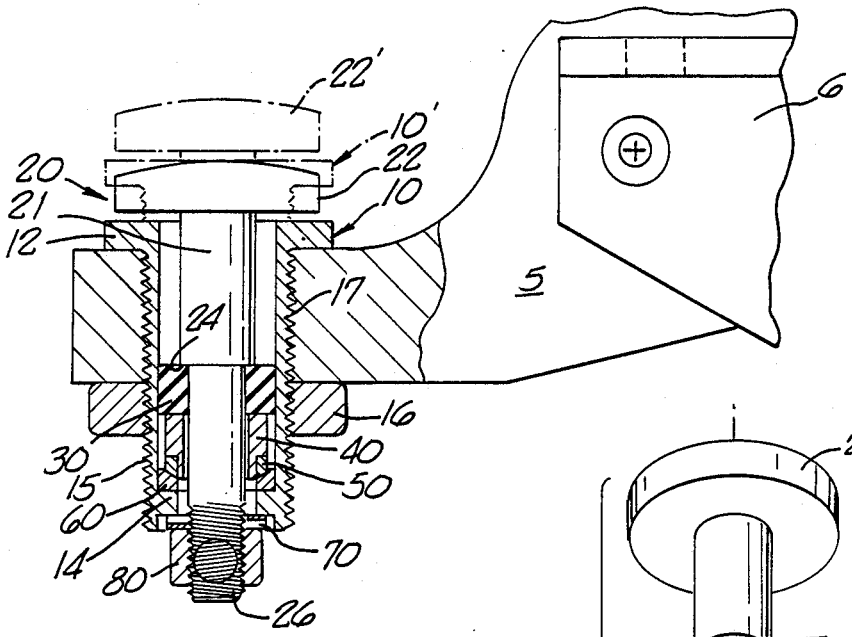
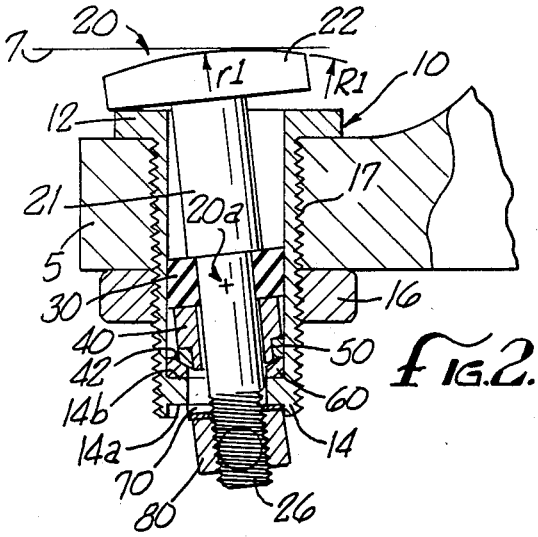
FIG. 2.
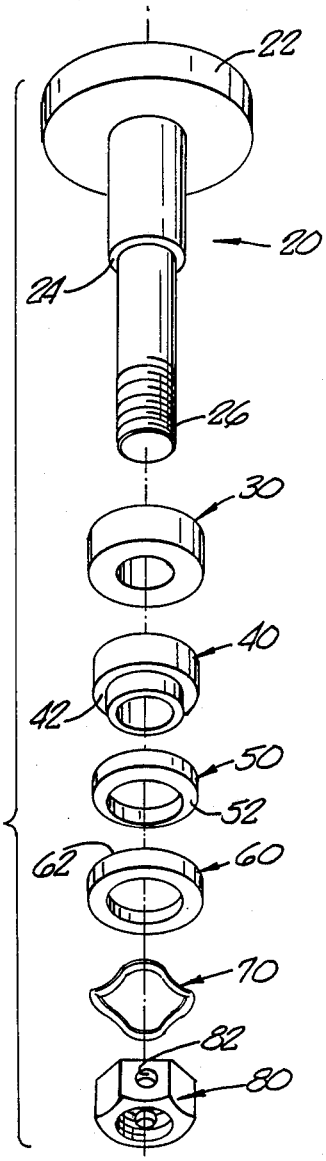
FIG. 3.

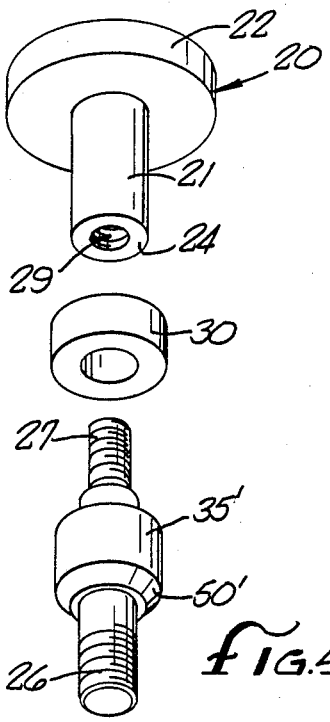
FIG. 4.
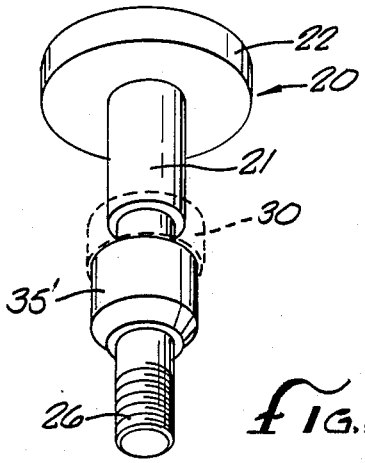
FIG. 5.
FIG. 6.
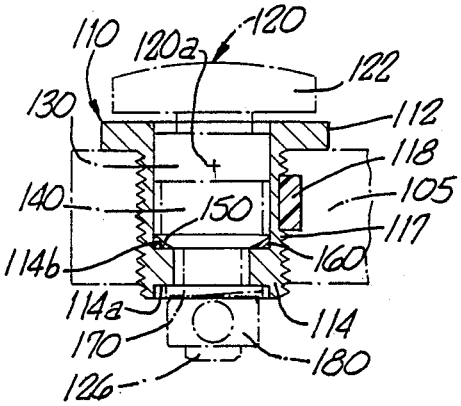
FIG. 7.
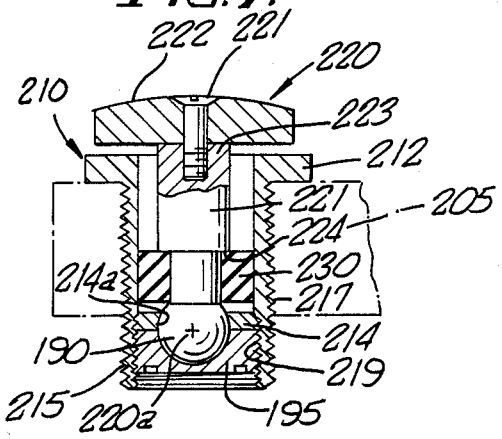
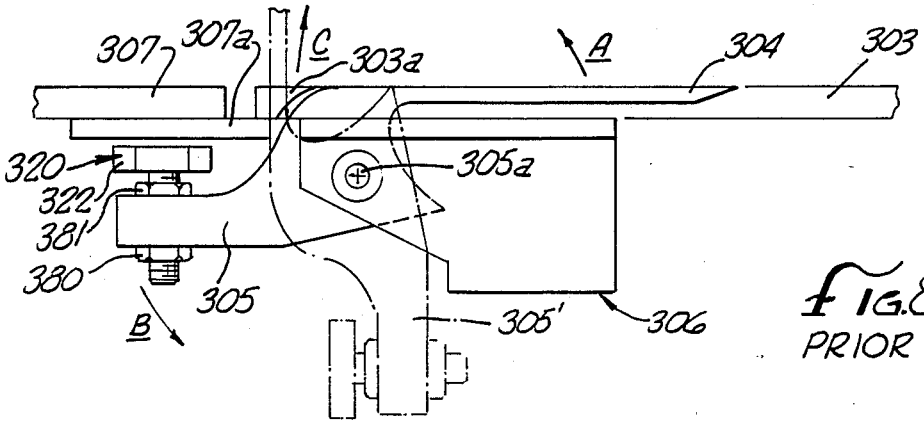
FIG. 8.
PRIOR ART

PIVOTING ADJUSTMENT SCREW

BACKGROUND OF THE INVENTION

The field of the present invention is securing devices such as latches.

When it is desired to secure a first element such as a (door) panel to a second element such as a frame, a common device for securing consists of a latch having a mating flange which rotates and locks in position against the frame, securing the panel in place. Such a device is illustrated in FIG. 8. A door 303 is to be secured against a frame 307. The edge 303*a* of the door 303 is secured against the door jam 307*a* of the mating flange or frame 307 by a latch 306 on the door 303. The latch 306 includes a handle 304 pivoting in a direction A about a pivot point 305*a* thereby rotating a latch arm 305 in a direction B away from the door frame 307 (to the position shown by the flange 305' in broken line) thereby allowing the door 303 to open in a direction C.

The contact point of the latch arm 305 is typically a screw or bolt 320 which also provides height adjustment. The bolt is positioned on the arm 305 and locked at the desired height with a locking nut 380, 381 on either side of the latch arm 305 so the bolt head 322 contacts the frame 307.

For most applications, the bolt and nut securing means is totally adequate. However, conditions with vibration between the two elements may render the typical bolting means inadequate.

One problem which occurs is where a door is being secured down to a thin panel or mating flange and the door (or the mating flange) is subject to vibration. As the door vibrates, it moves parallel to the mating flange rubbing the bolt head against the mating flange causing wear and possibly wearing through the mating flange itself. The rubbing may also cause wear on the latch arm at the bolt connection or other location. In addition, as the head of the bolt rubs against the mating flange, it typically wears a circular pattern into the mating flange. As this wear continues, preload is decreased thereby permitting additional movement between the two elements further increasing wear between the elements.

The wear difficulties are most noticeable in applications of high vibration and large securing preloads. It is therefore desireable to reduce this wear and avoid loss of preload.

SUMMARY OF THE INVENTION

The present invention is directed to providing a adjustment screw which provides protection from vibration between elements being secured. The adjustment screw may also provide vibrational damping along with increasing preload as the contact point of the adjustment screw to the mating structure shifts in a shock or vibrational environment. The adjustment screw includes a pivoting means which allows a rolling rather than a scraping or abrading movement in response to the relative movement between the mating structure, the element being secured.

BRIEF DESCRIPTION OF THE DRAWINGS p

FIG. 1 is partial cross sectional view of a preferred adjusting screw according to the present invention;

FIG. 2 is the adjusting screw of FIG. 1 in a pivoting condition;

FIG. 3 is an exploded view of the adjusting screw of FIG. 1;

FIGS. 4 and 5 illustrate a modified screw permitting an alternate assembly method, FIG. 4 being an exploded view and FIG. 5 an assembled view;

FIG. 6 is an alternative adjusting screw with reduced overall length;

FIG. 7 is an alternative adjusting screw with a pivot ball connector; and

FIG. 8 is a latch of the prior art showing the door and frame.

DETAILED DESCRIPTION OF THE PREFERRED EMBODIMENT

The preferred embodiments of the present invention will now be described with respect to the drawings. To facilitate description, any numeral representing an element in one figure will represent the same element in any other figure.

FIG. 1 is a pivoting adjustment screw according to the present invention in partial cross section. FIG. 2 is the adjustment screw of FIG. 1 in a pivoting condition and FIG. 3 is an exploded view of the adjustment screw of FIGS. 1 and 2.

The adjustment screw is comprised primarily of a bolt 20 in a housing 10. The housing 10 has a flared end 12 which extends over one side of a latch arm 5. The latch arm 5 is pivotally attached on the latch 6 which is connected to a door (not shown) in a fashion similar to FIG. 8. The housing 10 has a threaded end 15 on an opposite side of the latch arm 5 over which a jam nut 16 may be threaded thereby securing the housing 10 on the latch arm 5 by tightening thereof. The housing 10 may have threads 17 which would correspond to threads within the latch arm 5 (also shown as 17) providing further securement of the housing within the latch arm 5. A threaded housing 10 may provide height adjustment for the bolt 20.

As shown the broken lines in FIG. 1, the housing 10' may be raised away the latch arm 5 with the jam nut 16 securing the housing 10' in place. Correspondingly, the bolt 20 head 22' is shown upward with the housing 10'.

The housing 10 has a generally cylindrical shape with an inner shaft s accommodate the insertion of the bolt 20. The housing 10 has an inner rim 14 at its threaded end 15. The inner rim or ridge 14 creates a shoulder or seating position on either side thereof a first inner rim seat 14*a* on the lower side of the inner rim 14 (as viewed in FIG. 2) and a second seat 14*b* on the other side of the inner rim 14 facing the flared end 12 of the housing 10.

The bolt has a head 22 at one end and a threaded end 26 at the opposite. The head 22 has a curved top surface for contacting a frame in FIG. 2. The bolt 20 has a shoulder 24 on a bolt shaft between the head 22 and the threaded end 26, the shoulder 24 facing the threaded end 26. A resilient spacer 30 is inserted over the threaded end 26 onto the bolt shaft 21 and placed relationship with the shoulder 24. A sleeve 40 is also positioned over the threaded end 26 in abutting relation the resilient spacer 30. The sleeve 40 includes a shoulder 42 which when inserted onto the bolt 20 faces away from the head 22. A first or upper spherical washer 50 is inserted over the smaller end of the sleeve 40 to abut the shoulder 42. The upper spherical washer 50 has a spherical end 52 which when installed faces away from the bolt head 22.

A second or lower spherical washer 60 is positioned in the first seat 14*b* formed by the inner rim 14. The lower spherical washer 60 has a spherical end 62 which when installed is placed in contact with the spherical end 52 of the upper spherical washer 50. Assembly is completed by installing a wave washer 70 against the second seat 14*a* of the inner rim 14 and threading a nut 80 over the threaded end 26 of the bolt 20.

The mating relationship between the spherical ends 52 and 62 of the spherical washers 50 and 60 permits the pivoting action of the bolt 20 as shown in FIG. 2. The resilient spacer 30 compresses to permit the pivoting action. The sleeve 40 may also be of resilient material which compresses to permit the pivoting action. A locking pin (not shown) may be installed through a hole 82 within the nut 80 and into a corresponding hole within the threaded end 26. The pivoting action compresses the resilient spacer 230 and the wave washer 170 increasing preload applied by the bolt 120. This increase in preload dampens vibration at the same time as the pivoting action permits a rolling rather than a scraping or abrading movement in response to the relative movement between the elements being connected.

As viewed in FIG. 2, the bolt head 22 is held against the frame 7 holding the door in place. The latch arm 5 with the bolt 20 attached thereto may pivot downward in a counterclockwise direction as viewed in FIG. 2 thereby releasing the door 3 from the frame 7. The pivoting action of the bolt 20 along with the rolling action of the rounded bolt head 22 accommodates relative horizontal movement between the frame 7 and the latch arm 5. For example, as the frame 7 moves horizontally to the left as viewed in FIG. 1, the bolt 20 pivots about its center 20*a* in a counterclockwise direction, the curved surface of the bolt head 22 permitting a rolling movement along the frame 7 avoiding sliding or abrading contact therewith.

To achieve proper rolling contact, the radius of curvature $R_1$ of the top surface of the bolt head 22 is chosen to be greater than the pivot radius $r_1$, the distance between the pivot center 20*a* and the top curved surface of the bolt head 22. For most applications, the radius of curvature $R_1$ of the top surface of bolt head 22 is preferably about two times the pivot radius $r_1$ of the bolt 20. An appropriate range for the radius of curvature $R_1$ would be about $r_1 \leqq R \leqq 4R_1$.

Where the radius of curvature $R_1$ is too small, the bolt head 22 will not achieve a rolling action upon pivoting of the bolt 20. The bolt head 22 will merely drag along the surface of the frame 7 upon pivoting. When the radius of curvature $R_1$ is too large (for example at a very large radius, for practical purposes $R_1 = \infty$) the top surface of the bolt head 22 will be flat. Upon pivoting of the bolt 20, the bolt head 22 will not roll but pivot about an edge of the bolt head 22 (for example as viewed in FIG. 2, the bolt head 22 would pivot on its the upper right hand edge).

The size, length, and relative dimensions of the pivot radius, the bolt head radius, and the radii of the spherical washers are chosen based on size and space constraints, strength requirements, and the amplitude of relative vibrational movement between the latch arm 5 and the frame 7. The desired result is to provide rolling contact of the curved bolt head 22 against the frame 7 in response to relative movement between the frame 7 and the mating flange 5.

FIGS. 4 and 5 illustrate an alternative embodiment which permits a different assembly method for the bolt 20. In FIG. 4, the bolt 20 has a removable threaded portion 27 which corresponds to a female threaded portion 29 within the bolt 20 adjacent the shoulder 24. The threaded end 26 may then be removed from the head portion 22. The sleeve 35' may then be permanently affixed to the threaded portion 26 during the manufacture. The sleeve 35' may also include a spherical end 50' permanently affixed to the threaded end 26.

FIG. 6 illustrates an alternative pivoting adjustment screw 120 having a shorter length. The adjustment screw 120 includes a housing 110 having a flared end 112. The housing 110 is connected by a threaded connection 117 to the mating flange 105. The flared end 112 of the housing 110 may be tightened against the latch arm 105 or may be secured in position by a locking insert 118 between the threaded portions 117 of the housing 110 and the latch arm 105. The locking insert 118 also permits the height of the housing 110 to be adjusted without requiring a jam nut (such as jam nut 16 of FIG. 1) thereby allowing a shorter overall length. The housing 110 has an inner rim 114 with first and second seats 114*a* and 114*b*. FIG. 6 illustrates the adjustment screw 120 with a resilient spacer 130 and a sleeve 140 having a spherical end 150 which mates with a spherical end of a spherical washer 160 positioned within seat 114*b* formed by the inner rim 114. A nut 180 secured onto the threaded end 126 provides the desired tightening of the bolt 120. A wave washer 170 may be positioned between the nut 180 and the rim seat 114*a*. The bolt 120 may then pivot due to the allowable sliding relationship between spherical ends 150 and 160. The bolt 120 also has a shorter pivot radius from its pivot center 120*a* to the top of the bolt head 122.

FIG. 7 illustrates another embodiment where the pivoting securing means is comprised of a pivot ball 190 secured in a seat 214*a* connected along the inner rim 214 of the housing 210. A resilient spacer 230 secured along the bolt shaft 220 abuts a shoulder 224 which faces the pivot ball 190. Externally, the housing 210 is similar to previous embodiments having a flared end 212 and a threaded bottom 215. The housing is secured to the latch arm 205 by the threaded connection 217 therebetween. Alternately, height adjustment may be achieved with the addition of a jam nut as in FIG. 1 or with a locking insert as in FIG. 6. The adjustment screw 220 may include a detachable head 222 which is removable from the bolt shaft 220*a* by means of a head connector screw 221 which secures the bolt head thereon.

By way of example, two assembly methods will now be described. Though not fully illustrated, the pivot ball portion 190 of the bolt 220 may be removed from the bolt shaft 221*a* and head 222 in a similar fashion as that of the embodiment of FIG. 4. The pivot ball 190 is then securely fastened by a retainer ring 195 which is threadably tightened down a female threaded portion 219 within the bottom portion 215 of the housing 210. The rounded nature of the pivot ball 190 permits the bolt 220 to pivot Within the seat 214*a* of the rim 214.

In a second method of assembly, the inner rim 214 is threadably insertable into the female threaded portion 219 of the housing 210. The inner rim 214 is a split ring which may be installed around the pivot ball 190 before insertion into the housing 210. Once in place, the head 222 is secured to the bolt shaft 220 by the head connector screw 221.

The pivot point 220*a* of the adjustment screw 220 in FIG. 7 is in the center of the pivot ball 190. The radius of curvature of the top surface of the bolt head 222 is selected to be greater than the pivot radius (from the center point 220*a* to the top of the bolt head 222). Similar to the other embodiments, the radius of curvature of the top surface of the bolt head 222 is selected on the basis of the relation between that radius and the pivot radius of the bolt 220 (from the pivot center 220*a* to the top of the bolt head 222).

Thus, an adjustment screw permitting a pivoting action and allowing for increase in preload has been disclosed. While embodiments in application of this invention have been shown and described, it would be apparent to those skilled in the art that many more uses and modifications are possible without departing from the inventive concepts herein. The invention, therefore, is not to be restricted except in the spirit of the claims that follow.

What is claimed is:

1. An adjustment screw for mounting on a first member to abut against a second member comprising:

a housing insertable within a first member and having an inner rim forming a first and second seat;

a bolt positionable within the housing and having a head, a threaded end, and a shoulder between the head and the threaded end, the bolt shoulder facing the threaded end of the bolt;

a sleeve on the bolt with one end adjacent the bolt shoulder, the sleeve having a shoulder facing the threaded end of the bolt;

a first spherical washer on the sleeve with a first end abutting the sleeve shoulder and a spherical second end facing the threaded end of the bolt;

a second spherical washer positioned in the first seat of the housing and having a spherical end engaging the spherical second end of the first spherical washer; and a nut threaded onto the threaded end of the bolt adjacent the second seat of the housing.

2. The adjustment screw according to claim 1 further comprising a resilient spacer on the bolt between the bolt shoulder and the sleeve, the sleeve abutting the bolt shoulder through the resilient spacer.

3. The adjustment screw according to claim 1 further comprising a wave washer between the nut and the second seat of the housing.

4. The adjustment screw according to claim 1 wherein the housing has a flared end extending over one side of the first member, a threaded end extending past another side of the first member, and a jam nut threaded onto the threaded end of the housing for securing the housing to the first member.

5. The adjustment screw according to claim 1 wherein the housing is theadably insertable into a first member.

6. The adjustment screw according to claim 1 wherein the bolt is comprised of a first portion including the head and a second portion including the threaded end, the second portion being threadably connectable to the first portion.

7. The adjustment screw according to claim 1 wherein the head of the bolt has a curved surface allowing rolling contact.

8. The adjustment screw according to claim 7 wherein the curved surface has a radius of curvature greater than a pivot radius of the bolt.

9. The adjustment screw according to claim 7 wherein the curved surface has a radius of curvature $R_1$ selected in the range of:

$$r_1 \leqq R_1 \leqq 4r_1,$$

where $r_1$ is the pivot radius of the bolt

10. An adjustment screw for mounting on a first member to abut a second member comprising:

a housing insertable within a first member and having an inner rim forming a first and second seat;

a bolt positioned within the housing and having a head on one end of the bolt facing the first seat, a threaded end adjacent the second seat, and a shoulder between the head and the threaded end, the bolt shoulder facing the threaded end of the bolt;

a sleeve on the bolt with a first portion abutting the bolt shoulder and a second portion with a spherical end facing the threaded end of the bolt;

a spherical washer positioned in the first seat of the housing and having a spherical end engaging the spherical end of the second portion; and a nut threaded onto the threaded end of the bolt adjacent the second seat.

The adjustment screw according to claim 10 further comprising a wave washer between the nut and the second seat of the housing.

11. The adjustment screw according to claim 10 further comprising a wave washer between the nut and the second seat of the housing.

12. The adjustment screw according to claim 10 wherein the housing has a flared end extending over one side of the first member, a threaded end extending past another side of the first member, and a jam nut threaded onto the threaded end of the housing securing the housing to the first member.

13. The adjustment screw according to claim 10 wherein the bolt is comprised of a first portion including the head and a second portion including the threaded end, the second portion being threadably connectable to the first portion.

14. The adjustment screw according to claim 10 wherein the head of the bolt has a curved surface allowing rolling contact.

15. An adjustment screw for securing first member to abut against a second member comprising:

a housing insertable within a mating flange;

a bolt positioned within the housing, the bolt comprising a head on one end thereof, the head having a curved top surface for providing a rolling contact against a member to be secured; and a securing means on an opposite end thereof constructed and arranged to secure the opposite end of the bolt to the housing; and a pivoting means between the bolt and the housing.

16. The adjustment screw according to claim 1 wherein the head is detachably connected to the bolt.

17. The adjustment screw according to claim 15 wherein the bolt includes a shoulder between the head and the securing means, the bolt shoulder facing the securing means on the bolt.

18. An adjustment screw for mounting a first member to abut against a second member comprising:

a housing insertable within a mating flange;

a bolt positioned within the housing, the bolt comprising a head on one end thereof and a securing means on an opposite end thereof; and a pivoting means between the bolt and the housing, wherein the pivoting means comprises an inner rim in the housing forming a first and second seat, a bolt positioned within the housing with the head on one end of the bolt facing the first seat, a threaded end adjacent the second seat, and a shoulder between the head and the threaded end, the bolt shoulder facing the threaded end of the bolt;

a sleeve on the bolt with a first portion abutting the bolt shoulder and a second portion with a spherical end facing the threaded end of the bolt;

a spherical washer positioned in the first seat of the housing and having a spherical end engaging the spherical end of the second portion; and a nut threaded onto the threaded end of the bolt adjacent the second seat.

19. The adjustment screw according to claim 15 wherein the pivoting means comprises a pivot ball attached to the opposite end of the bolt and pivotally secured in a seat in the housing.

20. The adjustment screw according to claim 15 wherein the head of the bolt has a curved surface allowing rolling contact.

21. The adjacent screw according to claim 15 wherein the head is detachably connected to the bolt.

* * * * *